US006952856B2

(12) United States Patent
Kaizuka

(10) Patent No.: US 6,952,856 B2
(45) **Date of Patent: *Oct. 11, 2005**

(54) IONIC TOOTHBRUSH

(75) Inventor: Kazutoshi Kaizuka, Fukuoka (JP)

(73) Assignee: Create Co., Ltd. (JP)

( * ) Notice: Subject to any disclaimer, the term of this patent is extended or adjusted under 35 U.S.C. 154(b) by 313 days.

This patent is subject to a terminal disclaimer.

(21) Appl. No.: 10/039,843

(22) Filed: Nov. 6, 2001

(65) Prior Publication Data

US 2003/0084534 A1 May 8, 2003

(51) Int. Cl.[7] ..... A46B 15/00
(52) U.S. Cl. ..... 15/207.2; 428/372
(58) Field of Search ..... 15/207.2; 428/372

(56) References Cited

U.S. PATENT DOCUMENTS

| | | | | | |
|---|---|---|---|---|---|
| 236,522 | A | | 1/1881 | Wilson | |
| 278,944 | A | | 6/1883 | Hauce | |
| 294,309 | A | | 2/1884 | Campbell | |
| 1,455,696 | A | | 5/1923 | Wright | |
| 2,155,282 | A | | 4/1939 | Schoenling | |
| 3,228,845 | A | | 1/1966 | Najjar | |
| 3,613,143 | A | * | 10/1971 | Muhler et al. | 15/167.1 |
| 3,618,154 | A | * | 11/1971 | Muhler et al. | 15/167.1 |
| 3,703,766 | A | | 11/1972 | Tibbals | |
| 4,035,865 | A | | 7/1977 | McRae et al. | |
| 4,143,126 | A | | 3/1979 | Gaffar | |
| 4,151,850 | A | | 5/1979 | Nathe et al. | |
| D253,973 | S | | 1/1980 | Rosse | |
| 4,242,567 | A | | 12/1980 | Carter | |
| 4,477,716 | A | | 10/1984 | Thaler et al. | |
| 4,500,939 | A | * | 2/1985 | Gueret | 361/221 |
| 4,549,560 | A | | 10/1985 | Andis | |
| 4,567,904 | A | | 2/1986 | Pitcher et al. | |
| 4,610,925 | A | * | 9/1986 | Bond | 428/368 |
| 4,739,151 | A | | 4/1988 | Smal | |
| 4,740,669 | A | | 4/1988 | Takimae | |
| 4,886,972 | A | | 12/1989 | Nakai et al. | |
| 4,917,078 | A | | 4/1990 | Zaborowski | |
| D309,354 | S | | 7/1990 | Rizzuto et al. | |
| 5,056,227 | A | | 10/1991 | Kramer | |
| 5,124,143 | A | | 6/1992 | Muhlemann et al. | |
| 5,224,397 | A | | 7/1993 | Yoo | |
| 5,266,304 | A | | 11/1993 | Baffelli et al. | |
| 5,357,988 | A | | 10/1994 | Nakamura | |
| 5,531,675 | A | | 7/1996 | Yoo | |
| 5,722,106 | A | * | 3/1998 | Masterman et al. | 15/167.1 |
| 5,787,525 | A | | 8/1998 | Sugihara et al. | |
| 5,799,671 | A | | 9/1998 | Takimae | |
| 5,848,599 | A | | 12/1998 | Todd | |
| 5,891,473 | A | | 4/1999 | Stanier | |
| D411,333 | S | | 6/1999 | Smal | |
| 5,934,293 | A | | 8/1999 | Kaizuka | |
| 5,935,483 | A | | 8/1999 | Kong | |

(Continued)

FOREIGN PATENT DOCUMENTS

| | | |
|---|---|---|
| DE | 3120576 A1 | 1/1983 |
| DE | 19711676 A1 | 9/1998 |

(Continued)

OTHER PUBLICATIONS

Sakamoto, et al., Effect of a Toothbrush with Ion–coated Nylon Filaments on Gingival Tissue in Dogs and Dental Plaque Accmulation in a Man, 2002, pp. 221–228, J. Dent. Hlth. 52; Okayama Univ. School of Medicine, Japan.

Watanabe, et al., A Clinical Study to Evaluate the Effectiveness of a Multi–mineral Nylon Abrasive Filament (NAF) Toothbrush; pp. 1–12, Okayama University School of Medicine, Japan.

*Primary Examiner*—Mark Spisich
(74) *Attorney, Agent, or Firm*—Squire Sanders & Dempsey, L.L.P.

(57) ABSTRACT

A toothbrush with bristles containing a far-infrared emitting material and multi-element minerals is disclosed. The negative ions and radiation emitted from the bristles stimulate the cells of the gums and help prevent periodontal conditions.

10 Claims, 3 Drawing Sheets

U.S. PATENT DOCUMENTS

| | | | | | |
|---|---|---|---|---|---|
| 5,987,688 | A | * | 11/1999 | Roberts et al. | 15/167.1 |
| 6,029,277 | A | | 2/2000 | Picchione, II | |
| 6,029,356 | A | | 2/2000 | Sprinkle | |
| D424,742 | S | | 5/2000 | Hirata | |
| 6,105,261 | A | | 8/2000 | Ecer | |
| 6,205,674 | B1 | | 3/2001 | Kaizuka | |
| 6,357,075 | B1 | * | 3/2002 | Kaizuka | 15/207.2 |

FOREIGN PATENT DOCUMENTS

| | | | |
|---|---|---|---|
| DE | 19803175 | A1 | 7/1999 |
| EP | 0 077600 | A2 | 4/1983 |
| EP | 0 0160320 | A2 | 11/1985 |
| EP | 0927544 | B1 | 7/1999 |
| EP | 1086634 | | 11/1999 |
| GB | 1210385 | | 10/1970 |
| GB | 2301772 | A | 12/1996 |
| JP | 63150011 | | 6/1988 |
| JP | 63238808 | | 10/1988 |
| JP | 03241025 | | 10/1991 |
| JP | 03250088 | | 11/1991 |
| JP | 956472 | | 3/1997 |
| JP | 09121996 | | 5/1997 |
| JP | 11056425 | | 3/1999 |
| JP | 2000-128750 | | 5/2000 |
| JP | 2001288679 | | 10/2001 |
| JP | 2002-313855 | | 10/2002 |
| KR | 0117366 | | 7/1996 |
| RU | 2108299 | | 4/1998 |
| WO | WO 02/058449 | A2 | 8/2002 |
| WO | WO 02/058449 | A3 | 8/2002 |

* cited by examiner

IONIC TOOTHBRUSH

BACKGROUND OF THE INVENTION

1. Field of the Invention

The present invention relates generally to a toothbrush and, more particularly, to a toothbrush with processed bristles formed from a combination of nylon, a sandstone powder, a multi-element mineral, and a far-infrared emitting material.

2. General Background and State of the Art

Toothbrushes have been in use for a number of years. Conventional toothbrushes generally include nylon bristles for strength as well as resistance to abrasion, and provide moderate stimulation of the gums. When conventional toothbrushes are used to brush the teeth, toothpaste may first be applied to the nylon bristles in order to sufficiently remove unwanted matter from the teeth. Tartar is particularly difficult to remove once firmly attached to the teeth, and requires a large amount of toothpaste. Moreover, conventional toothbrushes are not capable of stimulating the gums, i.e. by generating negative ions from their bristles.

Thus, there is a need for a toothbrush that is capable of effectively removing tartar from the teeth with only the use of water or a small amount of toothpaste, and improving blood circulation in the gums to prevent periodontal disease.

BRIEF DESCRIPTION OF THE INVENTION

The toothbrush of the present invention comprises two types of bristles, at least some of which incorporate a mixture of nylon, a sandstone powder, a multi-element mineral powder, and a far-infrared emitting material.

When brushing the teeth with the toothbrush of the present invention, the composition of the processed bristles causes emission of far-infrared radiation from the far-infrared emitting material, thereby stimulating the cells of the gums.

Furthermore, electromagnetic waves (feeble energy) with wavelengths of 4 to 14 $\mu$m, which are emitted from the multi-element minerals can transform the surrounding of an atomic nucleus such that the atom and the material reach an excited state. This transformation causes a cutting and shortening of the polymerization of water clusters, decreasing the volume of water and increasing the specific gravity. Moreover, sufficient attachment of free water onto the external cell membranes of animals and plants occurs from the transformation. As a result, penetration of water and $Ca^{2+}$ is promoted within the cells, activating several functions of the cells. These electromagnetic waves are applied to the teeth and gums. In addition, when the bristles of the toothbrush come into contact with the teeth and gums; water within the oral cavity will be mineralized and the cells of the gums will be activated, facilitating the removal of tartar from the teeth. As an additional benefit, the combined actions of the anions and of electromagnetic waves promote blood circulation in the gums. This can prevent the occurrence of periodontal disease.

The above described and many other features and attendant advantages of the present invention will become apparent from a consideration of the following detailed description when considered in conjunction with the accompanying drawings.

BRIEF DESCRIPTION OF THE DRAWINGS

A detailed description of the invention will be made with reference to the accompanying drawings wherein.

DETAILED DESCRIPTION OF THE PREFERRED EMBODIMENTS

This description is not to be taken in a limiting sense, but is made for the purpose of illustrating the general principles of the invention. The organization of the present detailed description is for the purpose of convenience only and are not intended to limit the present invention.

According to the present invention, the bristles of a toothbrush are made of nylon combined with a sandstone powder, a multi-element mineral powder, and a far-infrared emitting material. As used herein, the term multi-element mineral contains multiple elements in a preferable balance, for example, including silicon-based minerals such as granite, perlite, pitchstone, and tourmaline as main components. These minerals radiate electromagnetic waves (feeble energy) and release anions. The action of the anions produces a water clustering affect, increasing the carrying capacity of water by reducing the size of water molecule groups, and allowing for tartar to be more effectively removed from the teeth.

With respect to the multi-element mineral used in this embodiment, perlite is preferably milled into a powder the size of about 1 to 3 microns using a ball mill. Blending two or more such minerals with the proper blending ratio forms the preferable multi-element mineral powder, however, a single mineral powder may also be used. The sandstone is also milled into a powder the size of about 1 to 3 microns using a ball mill. Blending two or more varieties of sandstone with the proper blending ratio forms the preferable sandstone powder. The powders can be used without further processing. Alternatively, the powders can also be used after they are mixed with water, whether heated or pressurized, so that the clear liquid part of the water dries into a powder by vacuum-freeze drying or by spray drying methods.

The following table shows the content of perlite:

TABLE 1

| | |
|---|---|
| Anhydrous silicon ($SiO_2$) | 71.94% |
| Aluminum oxide ($Al_2O_3$) | 14.94% |
| Iron (II) oxide ($Fe_2O_3$) | 2.54% |
| Magnesium oxide (MgO) | 0.44% |
| Calcium oxide (CaO) | 2.47% |
| Alkali oxide ($K_2O + Na_2O$) | 6.87% |
| Manganese (I) oxide (MnO) | 0.03% |
| Phosphoric anhydride ($P_2O_5$) | 0.14% |
| Ignition loss | 3.43% |
| Drying loss (at 110° C.) | 0.07% |
| Other, titanium | trace |

The following table shows the content of sandstone:

TABLE 2

| | |
|---|---|
| Ignition loss | 3.48% |
| $SiO_2$ | 62.7% |
| $Al_2O_3$ | 18.9% |
| Iron (II) oxide ($Fe_2O_3$) | 5.56% |
| Calcium oxide (CaO) | 2.00% |
| $K_2O$ | 2.32% |

In TABLE 2, "ignition loss" corresponds to the kaolin cosmetics standard ignition loss (500° C. constant temperature).

As used herein, the term far-infrared emitting material includes powders of: alumina ($Al_2O_3$), titania ($TiO_2$), ferrite ($Fe_2O_2$), chromium oxide ($CrO_3$), silica ($SiO_2$), yttria ($Y_2O_2$), magnesia (MgO). These powders are blended to give off extreme infrared radiation at wavelengths that are easily absorbed into the cells of the gums.

Figure 1:
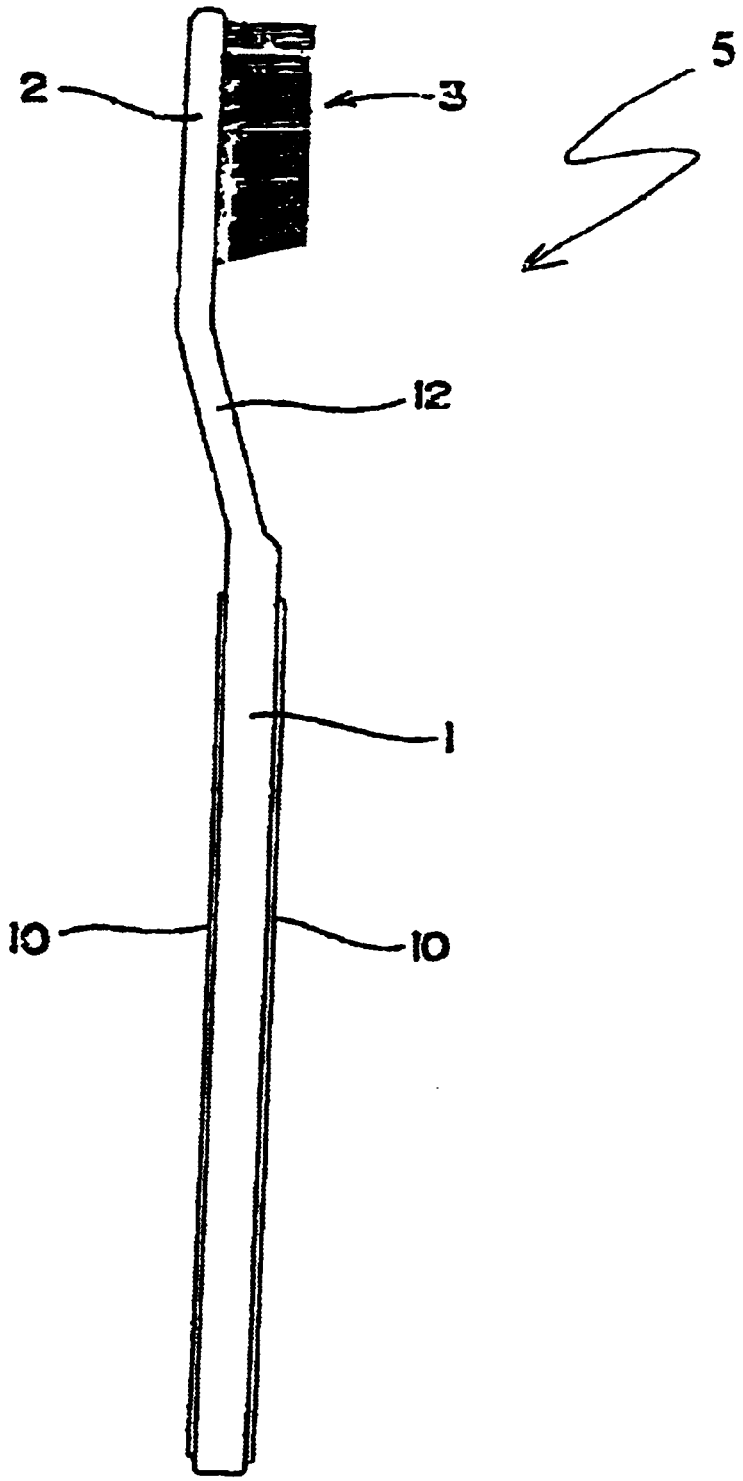
FIG. 1 is a perspective side view of a toothbrush according to one embodiment of the present invention.

FIG. 1 depicts a perspective side view of the toothbrush 5 according to the present invention. The toothbrush 5 includes a handle 1 connected to a base 2 on which an arrangement of bristles 3 is mounted. The handle 1 preferably has a bar shape and is made of polypropylene. Affixed to the handle 1 is a gripping surface for holding the toothbrush 5. The gripping surface for holding the toothbrush 5 may be configured as a non-slip pad 10 on both the top and bottom sides of the handle 1, making it easier to hold and use the toothbrush. The uppermost portion of the handle 1 may be disposed at a lightly downward angle such that it forms a narrow neck 12 that is connected to the base 2. The neck 12 is elastic in nature and angling the neck downwards further facilitates the elasticity of the base 2, which allows the teeth to be smoothly brushed at an angle suitable to the user.

Figure 2:
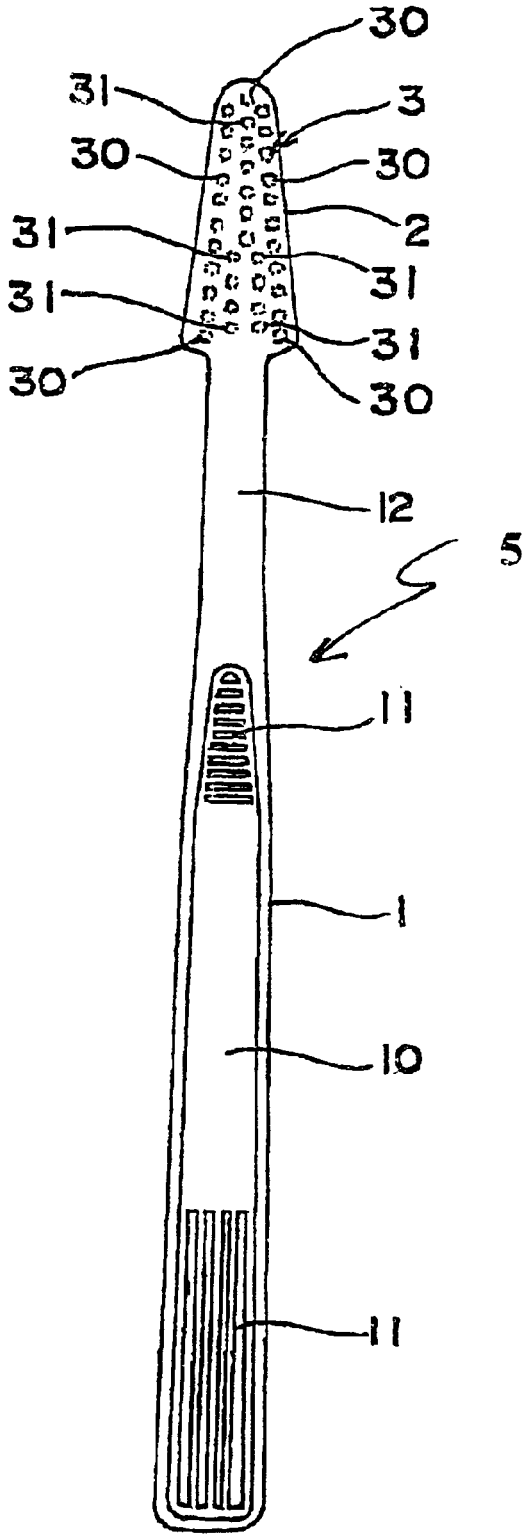
FIG. 2 is a perspective top view of the toothbrush of FIG. 1 according to the present invention.

FIG. 2 depicts a perspective top view of a toothbrush 5. The non-slip pads 10 on the handle 1 have a set of depressions and projections 11 running both horizontally and vertically. The base 2 is made of polypropylene. The bristles 3 are mounted on the base 2 with a bristle-mounting device. The bristles lining the exterior of the base 2 as illustrated include a set of nylon bristles 30 preferably made from a nylon or similar material. The bristles arranged in the interior of the base 2 as illustrated include a set of the processed bristles 31 preferably made of a mixture of nylon containing mixed powders. The mixed powders may include a sandstone powder, a multi-element mineral powder and a far-infrared emitting material, or any combination thereof. The percentage of the volume of the powder to that of nylon is preferably about 1 to 3% powder. If the percentage is over about 3% powder, the processed bristles 31 may bend easily and become unusable after a relatively short time. As shown in FIG. 1 other than those at the uppermost portion of the base, the nylon bristles (30) may be angled forward.

Figure 3:
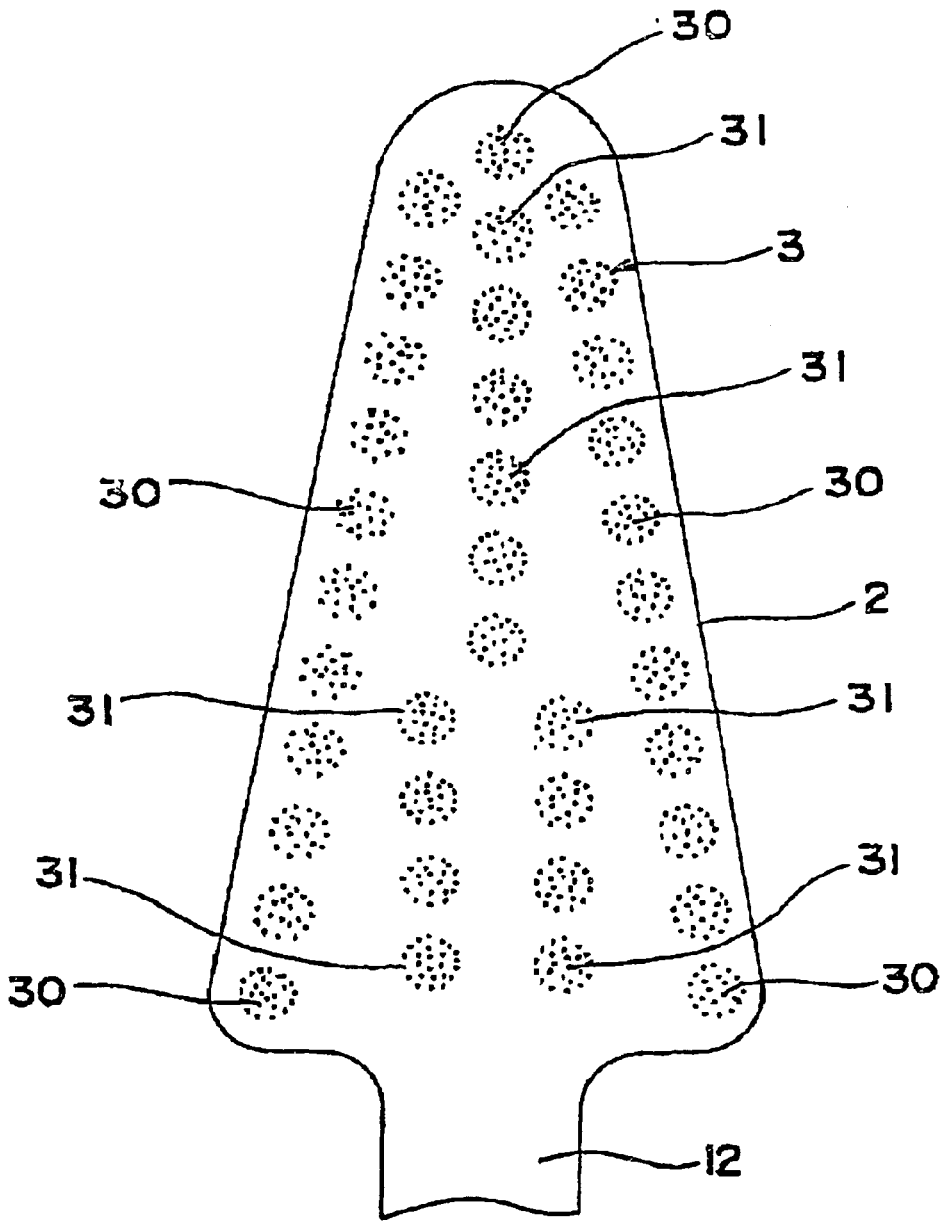
FIG. 3 is an enlarged view of a base of the toothbrush of FIG. 1 according to the present invention.

FIG. 3 depicts an enlarged view of the base 2 of the toothbrush 5 to which the bristles 3 are mounted according to an embodiment of the present application. The bristles arranged along the exterior of the base 2 are the nylon bristles 30 positioned as such to reduce damage to the gums while brushing the teeth. The processed bristles 31 are arranged in rows down the interior of the base 2. The bristles 3 should be immersed in water, or minimal amounts of toothpaste can be applied to the bristles, and then the toothbrush 5 should be used to brush the teeth in a conventional manner. With the arrangement of the nylon bristles 30 and the processed bristles 31 of the present invention, when the toothbrush 5 is used to brush the teeth, the processed bristles 31 constantly release anions and far-infrared rays, which affect the gums and mineralizes the water in the oral cavity. The synergy between the anions and the far-infrared rays emitted by brushing the processed bristles 31 against the teeth also releases electromagnetic waves, facilitating tartar removal from the teeth.

Thus, a novel and beneficial toothbrush has been disclosed. While variations of the illustrated preferred embodiment have been shown and described, it would be apparent to those skilled in the art that many more modifications are possible without departing from the inventive concepts herein. For example, another embodiment can be produced where all the mounted bristles are processed bristles 31. Moreover, there is no limitation to the illustrated arrangement of the nylon bristles 30 and the processed bristles 31. The invention, therefore, is not to be restricted except in the spirit of the appended claims.

What is claimed is:

1. A toothbrush, comprising:

a base;

a handle connected to said base; and bristles containing a combination of both a far-infrared emitting material and multi-element minerals, said bristles being attached to said base, wherein said far-infrared radiation material is a blended mixture of powders including alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO).

2. The toothbrush according to claim 1, wherein said multi-element mineral comprises silicon-based minerals.

3. The toothbrush according to claim 2, wherein said multi-element mineral comprises granite, perlite, pitchstone, and tourmaline.

4. A toothbrush, comprising:

a base;

a handle connected to said base; and a plurality of bristles attached to said base, at least some of said bristles formed from a combination of a blended mixture of far-infrared emitting powders including alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO), and a multi-element silicon-based mineral.

5. The toothbrush according to claim 4, wherein said multi-element silicon-based mineral comprises granite, perlite, pitchstone, and tourlamine.

6. A toothbrush, comprising:

a base;

a handle connected to said base; and a plurality of bristles attached to said base, at least some of said bristles formed from a combination of a blended mixture of far-infrared emitting powders includes at least one of titania ($TiO_2$), ferrite ($Fe_2O_3$), chromium oxide ($Cr_2O_3$), yttria ($Y_2O_3$), and magnesia (MgO), and a multi-element silicon-based mineral, wherein said multi-element mineral comprises granite, perlite, pitchstone, and tourmaline.

7. A toothbrush, comprising:

a base;

a handle connected to said base; and a plurality of bristles attached to said base, at least some of said bristles formed from a combination of a blended mixture of far-infrared emitting powders and a multi-element silicon-based mineral, the blended mixture of far-infrared emitting powders includes alumina ($Al_2O_3$) and at least one of titania ($TiO_2$), ferrite ($Fe_2O_3$), chromium oxide ($Cr_2O_3$), yttria ($Y_2O_3$), and magnesia (MgO), wherein said multi-element mineral comprises granite, perlite, pitchstone, and tourmaline.

8. A toothbrush, comprising:

a base;

a handle connected to said base; and a plurality of bristles attached to said base, at least some of said bristles formed from a combination of a blended mixture of far-infrared emitting powders and a multi-element silicon-based mineral, the blended mixture of far-infrared emitting powders includes silica ($SiO_2$) and at least one of titania ($TiO_2$), ferrite ($Fe_2O_3$), chromium oxide ($Cr_2O_3$), yttria ($Y_2O_3$), and magnesia (MgO), wherein said multi-element mineral comprises granite, perlite, pitchstone, and tourmaline.

9. A toothbrush comprising:

a base;

a handle connected to said base; and bristles formed from a powder combination and nylon, the powder combination formed from a far-infrared emitting material and a multi-element silicon-based mineral, where the powder combination is about 1% to 3% of volume of the nylon, and said bristles being attached to said base, wherein said far-infrared radiation material is a blended mixture of powders including alumina ($Al_2O_3$), titania ($TiO_2$), ferrite ($Fe_2O_3$), chromium oxide ($Cr_2O_3$), silica ($SiO_2$), yttria ($Y_2O_3$), and magnesia (MgO).

10. A toothbrush, comprising:

a base;

a handle connected to said base; and bristles formed from a powder combination and nylon, the powder combination formed from a far-infrared emitting material and a multi-element silicon-based mineral, where the powder combination is about 1% to 3% of volume of the nylon, and said bristles being attached to said base, wherein said multi-element mineral comprises granite, perlite, pitchstone, and tourmaline.

* * * * *